US008607840B2

(12) United States Patent
Beulen

(10) Patent No.: US 8,607,840 B2
(45) Date of Patent: Dec. 17, 2013

(54) ROLLER SHUTTER HAVING A SMOOTH OUTER SURFACE

(75) Inventor: Allegonda Petronella Gerarda Beulen, Reuver (NL)

(73) Assignee: Stayl GmbH, Salzbergen (DE)

( * ) Notice: Subject to any disclaimer, the term of this patent is extended or adjusted under 35 U.S.C. 154(b) by 20 days.

(21) Appl. No.: 13/264,792

(22) PCT Filed: Apr. 17, 2009

(86) PCT No.: PCT/NL2009/050207

§ 371 (c)(1),
(2), (4) Date: Dec. 27, 2011

(87) PCT Pub. No.: WO2010/053357

PCT Pub. Date: May 14, 2010

(65) Prior Publication Data

US 2012/0090793 A1 Apr. 19, 2012

(51) Int. Cl.
*E06B 9/15* (2006.01)

(52) U.S. Cl.
USPC ..... 160/133; 160/236

(58) Field of Classification Search
USPC ..... 160/133, 236, 235, 232, 183
See application file for complete search history.

(56) References Cited

U.S. PATENT DOCUMENTS

| | | | | |
|---|---|---|---|---|
| 2,898,988 | A * | 8/1959 | Zoll | 160/229.1 |
| 2,976,923 | A * | 3/1961 | Hirashiki | 160/229.1 |
| 3,850,465 | A * | 11/1974 | Hill et al. | 292/231 |
| 4,573,512 | A * | 3/1986 | Lichy | 160/133 |
| 5,220,951 | A * | 6/1993 | Dagenais | 160/199 |
| 5,456,305 | A * | 10/1995 | Snarli | 160/133 |
| 5,458,179 | A * | 10/1995 | Magaldi et al. | 160/183 |
| 5,472,037 | A * | 12/1995 | Hoffman | 160/183 |
| 5,566,739 | A * | 10/1996 | Hoffman | 160/183 |
| 6,041,847 | A * | 3/2000 | Lai | 160/236 |
| 6,189,593 | B1 * | 2/2001 | Katchur et al. | 160/133 |
| 6,263,943 | B1 * | 7/2001 | Lai | 160/133 |
| 6,874,560 | B2 * | 4/2005 | Escribano | 160/133 |

FOREIGN PATENT DOCUMENTS

| | | |
|---|---|---|
| DE | 3640319 C2 | 6/1995 |
| DE | 19828186 A1 | 1/1999 |
| FR | 2781249 A1 | 1/2000 |

(Continued)

OTHER PUBLICATIONS

Decision on Grant in connection with corresponding Russian application 2011146645/12(069932), dated Feb. 22, 2013.

*Primary Examiner* — David Purol
(74) *Attorney, Agent, or Firm* — Browdy and Neimark, PLLC

(57) ABSTRACT

A roller shutter comprises a series of links (2), each of which has a link plate (7) which determines two main surfaces (10, 11), two opposite longitudinal edges (8, 9) and two opposite transverse edges (12, 13), as well as eccentric hinge parts (4-6) which are situated near the longitudinal edges (8, 9), in each case two links (7) being hingedly connected to one another by means of the hinge parts (4-6), which series of links (2) can be brought into a rolled-up state, in which the links (2) are rotated with respect to one another, and an unrolled state in which the links (2) determine a substantially flat plane. Closure means (18) are provided on the longitudinal edges (8, 9), by means of which the link plates (7) are closed off with respect to one another in the unrolled, flat state of the series of link plates (7).

30 Claims, 10 Drawing Sheets

(56) References Cited

FOREIGN PATENT DOCUMENTS

| | | | | | |
|---|---|---|---|---|---|
| GB | 2189285 | A | * | 10/1987 | ..... E06B 9/10 |
| GB | 2290100 | A | | 12/1995 | |
| NL | 8802826 | A | | 6/1990 | |
| RU | 14962 | U1 | | 9/2000 | |
| RU | 69552 | U1 | | 12/2007 | |

* cited by examiner

ROLLER SHUTTER HAVING A SMOOTH OUTER SURFACE

The invention relates to a roller shutter, comprising a series of links, each of which has a link plate which determines two main surfaces, two opposite longitudinal edges and two opposite transverse edges, as well as eccentric hinge parts which are situated near the longitudinal edges, in each case two links being hingedly connected to one another by means of the hinge parts, in which the hinge parts comprise bushes which extend along the longitudinal edges distributed at regular intervals one behind the other, and the bushes on one of the end faces are offset with respect to the bushes on the other end face of a link in such a manner that the bushes of two neighbouring links intermate with one another, hinge pins being accommodated in the bushes with some play, which series of links can be brought into a rolled-up state, in which the links are rotated in an identical first direction with respect to one another, and an unrolled state in which the links determine a substantially flat plane.

A roller shutter of this type is known from NL-A-8.802.826, and is often used to close off relatively large openings in buildings, such as window displays and the like. An important purpose of the roller shutters is to protect the space behind, such as window displays and the like, banking institutions. The roller shutters therefore have to offer a high degree of resistance to attempted burglaries, in particular to so-called ram raids in which a vehicle is used to force the roller shutter open.

The links of the roller shutters are rotatable with respect to each other, as they have to be wound onto and from a roller which is usually positioned above the entrance or window display and the like. Said possibility to rotate with respect to each other is also present in the unrolled state of the roller shutter, be it that the links are held in the unrolled, straight position by means of the guides which are at the edges of the roller shutter. This rotational freedom however limits the impact resistance of the roller shutter.

The object of the invention is therefore to provide a roller shutter of the type described before which has an even better resistance against impacts. Said aim is achieved in that the bushes, on at least one of the end faces, each determine a cavity having an elongate shape, viewed in the direction from the one longitudinal edge to the other longitudinal edge, in such a manner that the links in the unrolled, flat state can be brought in an open position in which the longitudinal edges of adjoining link plates are at a distance from each other and allow rotation of said link plates in said first direction, and a closed position in which the link plates are closed off with respect to each other, and in that first stop means are provided which prevent rotation of the links with respect to one another in said first direction when in the closed position.

Once the links of the roller shutter rest upon each other in the closed position, they are unable to rotate in the first direction whereby an increased impact resistance is obtained. The first stop means can be carried out in several ways. According to a preferred embodiment, these first stop means comprise an outer surface part of a bush of one link plate and an opposite inner surface of another link plate coupled to said one link plate, said surface parts being opposite each other in the closed position of said link plates and abutting each other when said links determine said flat plane whereby rotation in the first direction is prevented, and being shifted sideways with respect to each other in the open position of said link plates and allowing rotation of said link plates in the first direction.

Said opposite surface parts can be at least partly flat, along the straight part of the elongated bushes. Also or alternatively, these opposite surface parts can be at least partly curved along the curved part of the elongated bushes.

Furthermore, the link plates may be rotatable with respect to one another from the flat plane in a second direction which is opposite to the first direction. Also, second stop means may be provided which determine a maximum angular rotation of the links with respect to one another in the second direction. In this connection, each of the links may comprises a stop face on both longitudinal edges, which stop faces are directed obliquely at different angles, viewed in cross section of the links, with the difference in angles being equal to the maximum angle through which the links can be rotated with respect to one another in the second direction from the flat plane. In which in each case one stop face may be situated next to each end face, viewed in cross section of the links.

Such closure means for the roller shutter have considerable advantages. Firstly, they result in a more aesthetic appearance of the roller shutter compared to the known embodiment with interruptions between the links. The seal between the links is also significantly improved, so that wind and dirt can no longer pass between the slats. The roller shutters are also significantly more burglar-proof, as the smooth, closed surface of the roller shutter has considerably fewer points of engagement. Furthermore, the insulating value of the roller shutter is improved as fewer or no gaps are exposed to the ambient air.

Connecting the closure means to one another in the desired manner is facilitated by the eccentric position of the hinge parts, which are situated, for example, on one of the main surfaces of the link plate and which are turned away from the other main surface.

The closure means of the roller shutter according to the invention can be designed in many different ways. According to a first possible embodiment, the closure means comprise end faces which are situated on the longitudinal edges of the link plates.

The links can bear against one another by means of these end faces. However, if the hinged connections between the links allow some play, they can also be kept a slight distance apart by not allowing the roller shutter to rest on the bottom edge but to keep it suspended from the winding shaft. In this context, it is important that, as a result of this play of the hinged connections between the links, the links can also be hinged clockwise with respect to the completely flat position, as illustrated in FIG. 1. In this case, the links can therefore be rolled up into a box which is situated on the outer side of the outer surface of the roller shutter. However, in the situation illustrated in FIG. 1, the roller shutter is rolled up into a box which is situated on the rear side of the roller shutter.

If the end faces of the links lie on top of and against one another, a good seal is ensured. This seal can be improved further by directing the end faces obliquely, viewed in a cross section which is at right angles to the pivot axes of the hinge parts. The seal against rain, dirt and the like can be improved still further by directing the one oblique end face of the link plates away from the hinge parts and directing the other oblique end face towards the hinge parts. As a result thereof, in the unrolled state of the series, the lower oblique end face of a link may be directed towards the main surface which is turned towards the hinge parts, which lower oblique end face covers the higher end face of the lower link.

According to yet another embodiment, the one end face of the link plate can be convex and the other end face can be concave. The lower end face is preferably concave; the lower concave end face can then cover the higher end face of the lower link. Alternatively, the end faces can also be designed to be bent.

In the above-described embodiment, the sealing between the links is achieved by allowing the end faces to bear against one another. However, other ways of sealing are also possible. By way of example of another sealing, a flexible element is mentioned which is situated between the link plates. In that case, the end faces of the link plates themselves do not have to bear against one another in order to achieve a sealing effect, but they can be at some distance to one another while enclosing the flexible element.

The hinge parts comprise bushes which extend along the end faces distributed at regular intervals one behind the other. The bushes on one of the end faces are offset with respect to the bushes on the other end face of a link in such a manner that the bushes of two neighbouring links intermate with one another. Hinge pins may be accommodated in the intermating bushes. The number of bushes on each end face may vary. There may, for example, be two bushes per end face, but also three, four, five, six and so forth. Preferably, links are used in each case which have the same number of bushes per end face, but this is not compulsory.

Hinge pins are accommodated in the bushes with some play. Thus, it is not only possible to rotate the links from the flat plane in said first direction with respect to one another, but also in the opposite direction from the flat plane. This is particularly useful for roller shutters in which the box, in which the roller shutter is to be accommodated, protrudes outwards with respect to the opening in the façade which is closed off by the roller shutter. When moving the links upwards, these have to be rotated backwards with respect to one another first, before they can be wound onto the winding shaft in the opposite direction.

The play which this requires between the bushes and the hinge pins is be achieved in that the bushes, on at least one of the end faces, each determine a cavity having an elongate shape, viewed in the direction from the one longitudinal edge to the other longitudinal edge, in such a manner that the links can be rotated with respect to one another from the flat plane in a second direction which is opposite to the first direction. Of course, it is also possible to provide the bushes on both longitudinal edges with such an elongate shape, but this is not compulsory.

In order to limit the maximum angular rotation of the links with respect to one another in the second direction from the flat plane, stop means are provided which determine a maximum angular rotation of the links with respect to one another in the second direction. In particular, each of the links may comprise a stop face on both longitudinal edges, which stop faces are obliquely directed at different angles, viewed in cross section of the links, with the difference in angles being equal to the maximum angle through which the links can be rotated with respect to one another in the second direction from the flat plane.

In the above description, mention is made of links, each of which is provided on both longitudinal edges with a shaped end face. Said stop faces may be situated next to said end faces, viewed in cross section of the links. Preferably, the stop faces are situated on the outer side of the link, that is to say on that side which is turned away from the side with respect to which the bushes protrude.

In the known embodiment, rows of links are provided, the transverse edges of which abut one another. In order to further improve the sealing of the roller shutter, the transverse edges of the links may be provided with closure means. Thus, for example, there may be in each case a lip situated on one of the transverse edges of each link, which lip extends over the transverse edge of a neighbouring link. Furthermore, each of the links can comprise an auxiliary plate which extends next to the main surface of the link plate in which the hinge parts are situated. The links are preferably made of transparent plastic material.

The hinge pins of the hinge parts may be oriented horizontally; according to an alternative embodiment, the hinge pins can, however, be oriented vertically, in such a manner that the hinges can be unrolled and rolled up next to one another.

The invention will be explained in more detail below with reference to an exemplary embodiment illustrated in the figures, in which.

Figure 1:
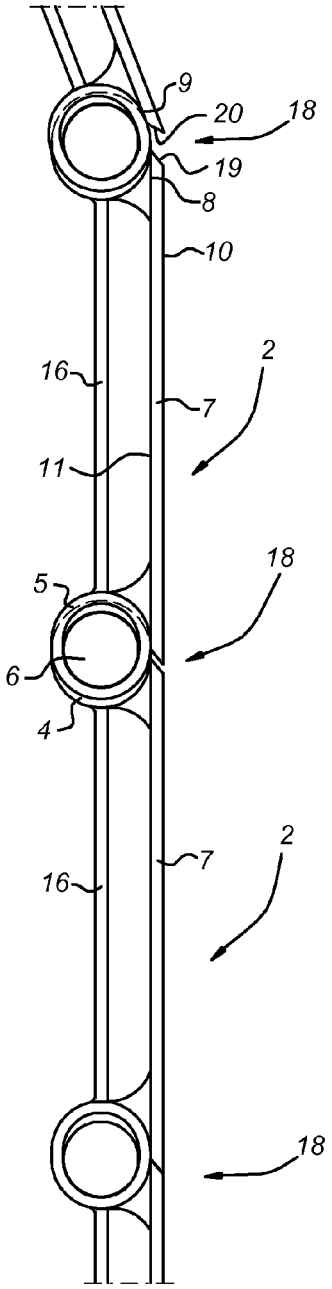
FIG. 1 shows a vertical cross section of a first variant of a roller shutter according to the invention, along I-I in FIG. 5.
Figure 5:
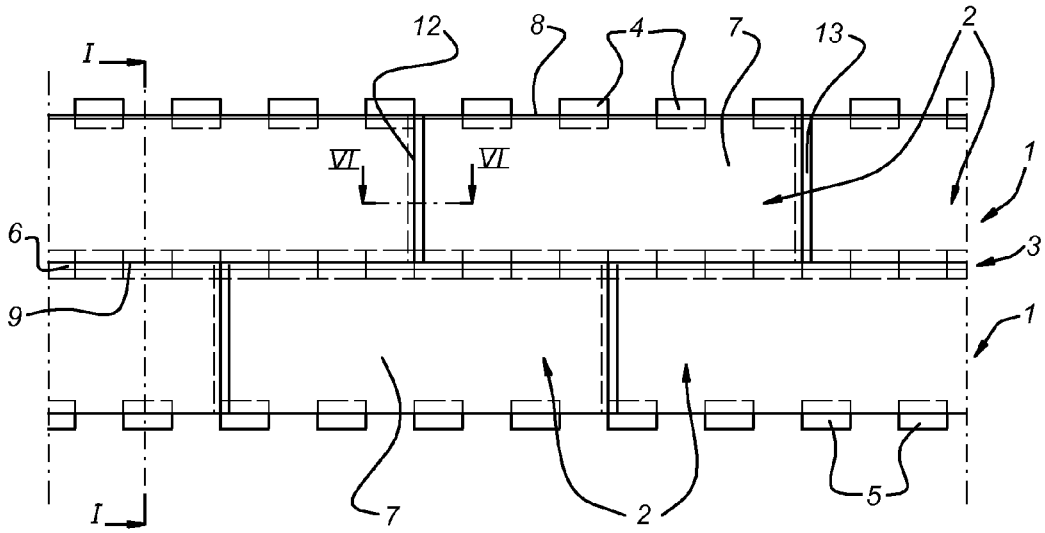
FIG. 5 shows a front view of a part of the roller shutter.
Figure 8:
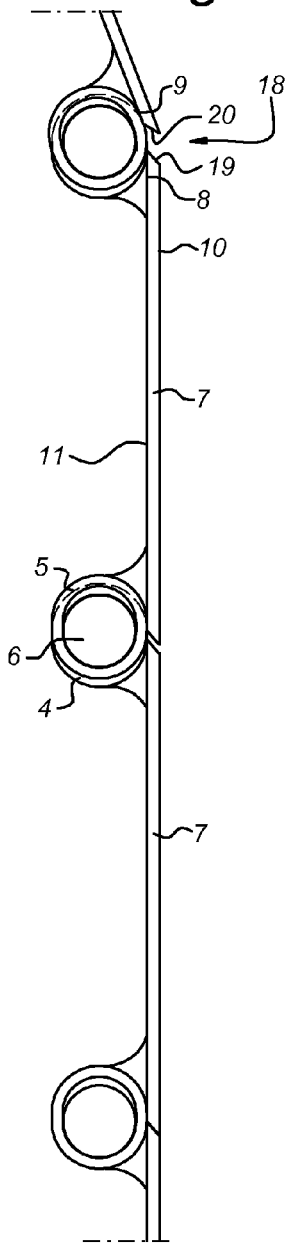
Figure 7:
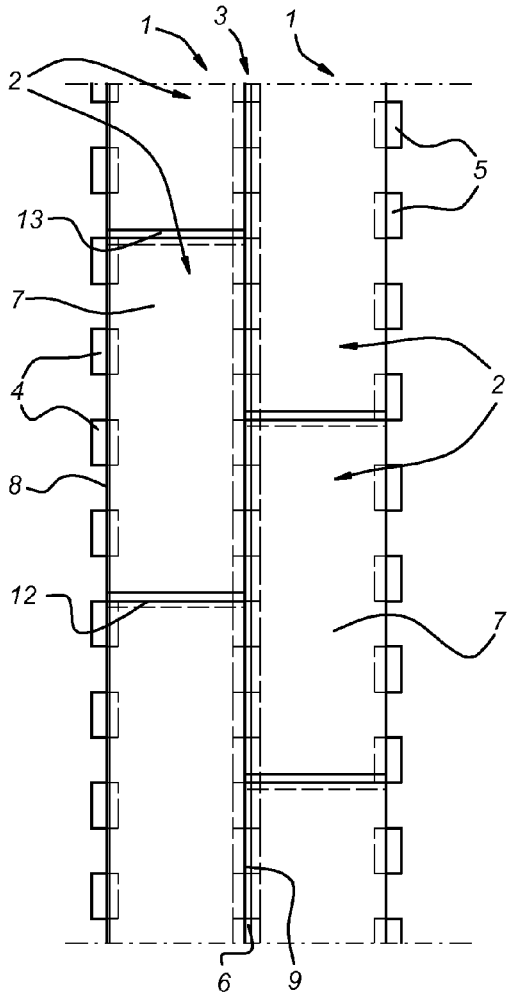
Figure 9:
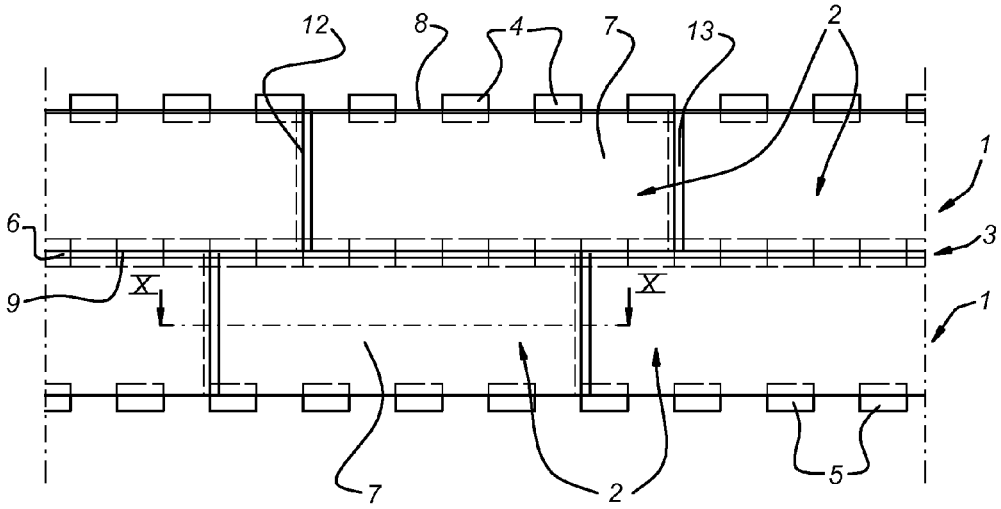
Figure 10A:
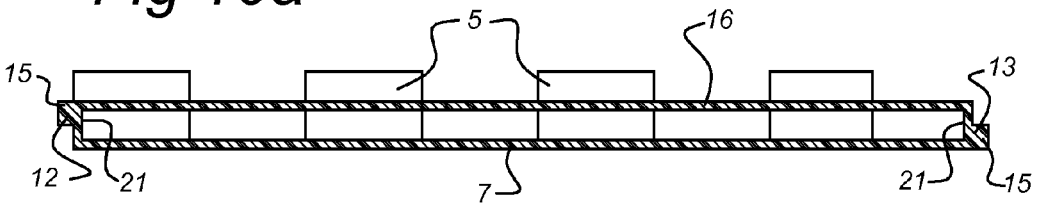
Figure 10B:
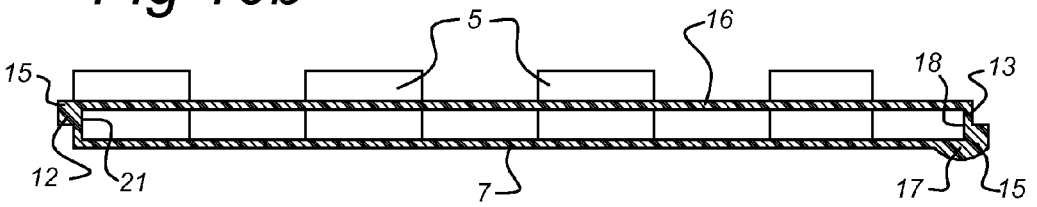
Figure 10C:
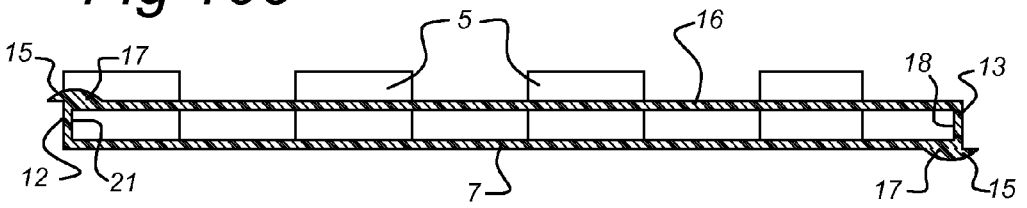
Figure 11:
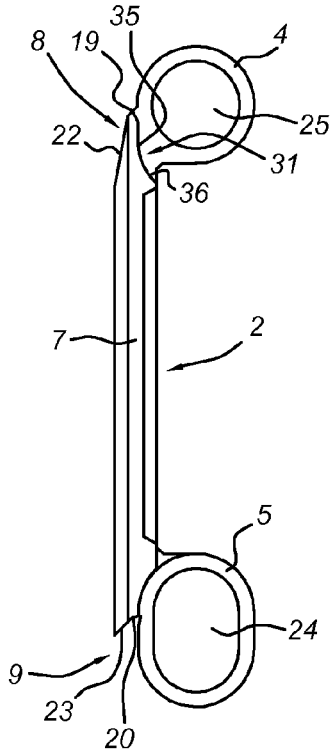
Figure 12:
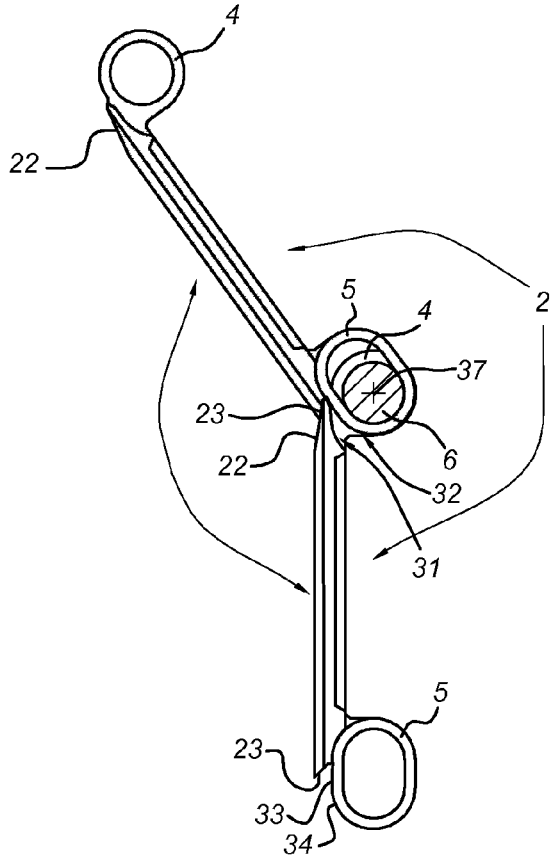
Figure 13:
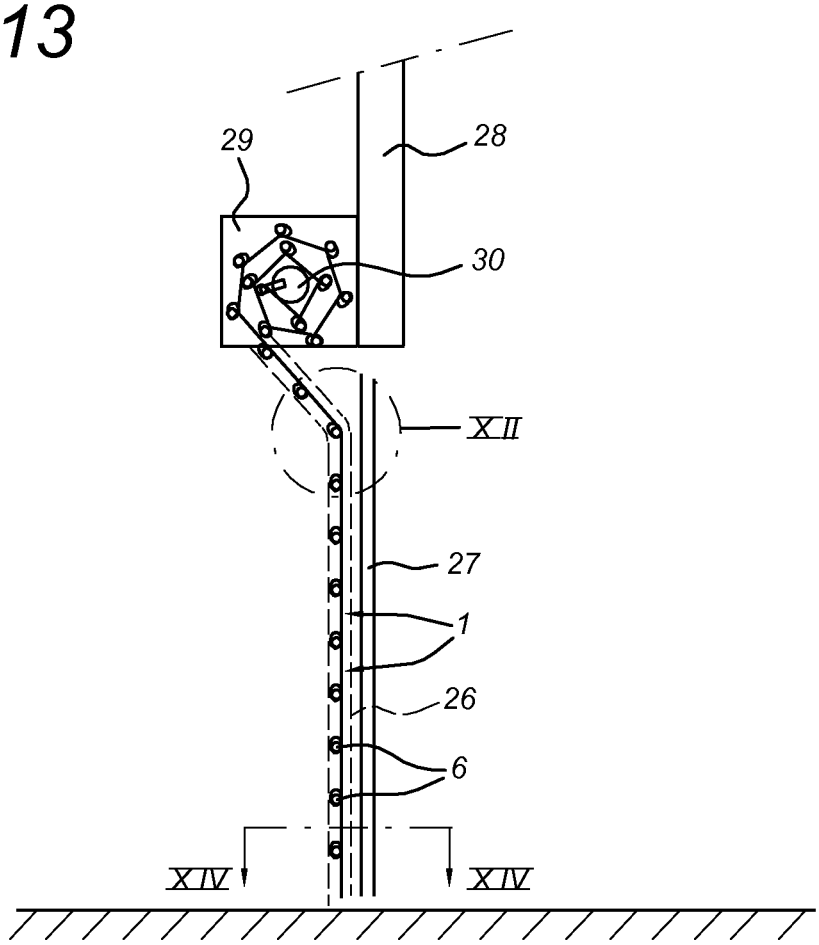
Figure 14:
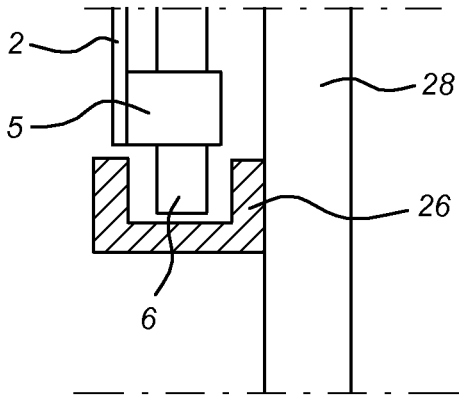
Figure 15:
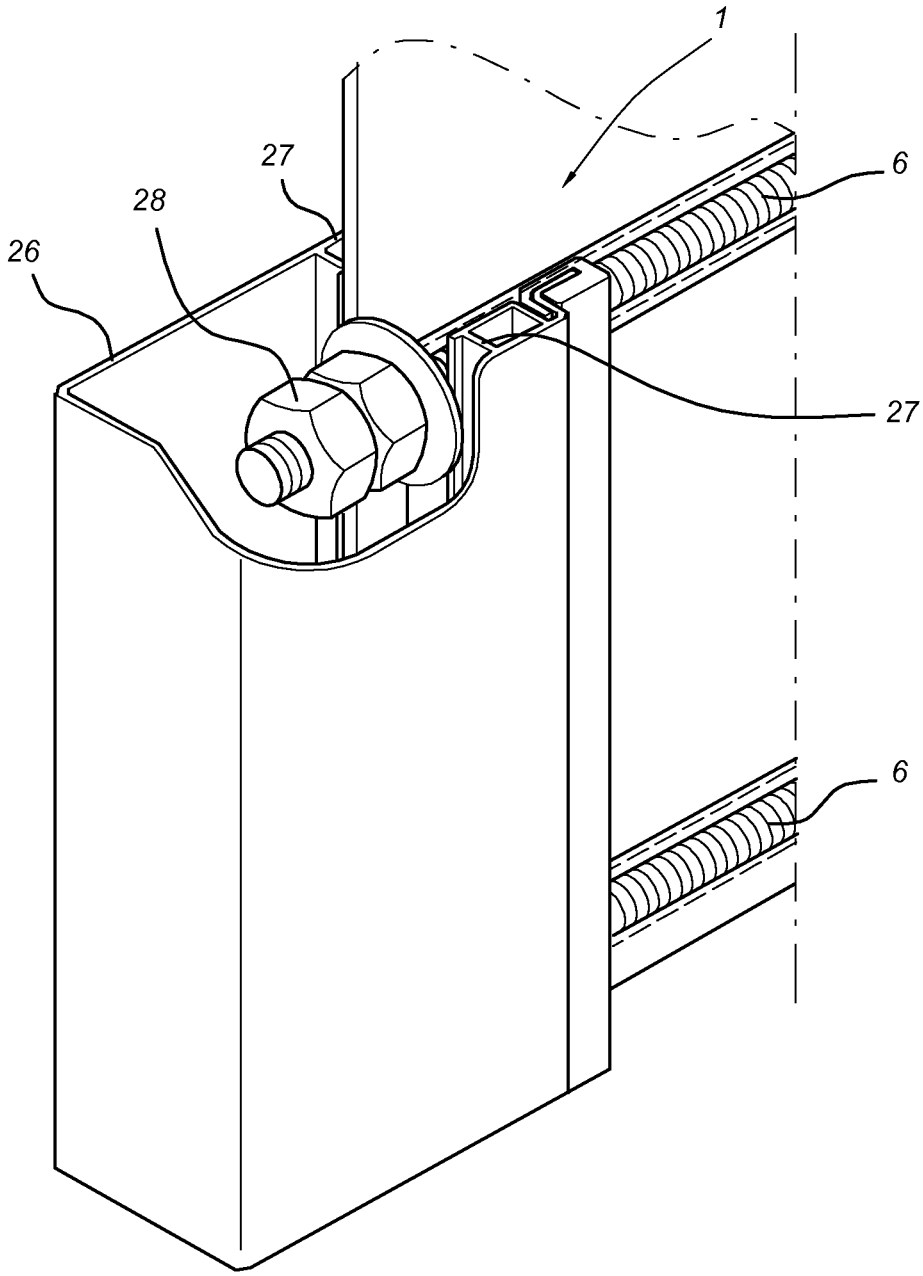
Figure 16:
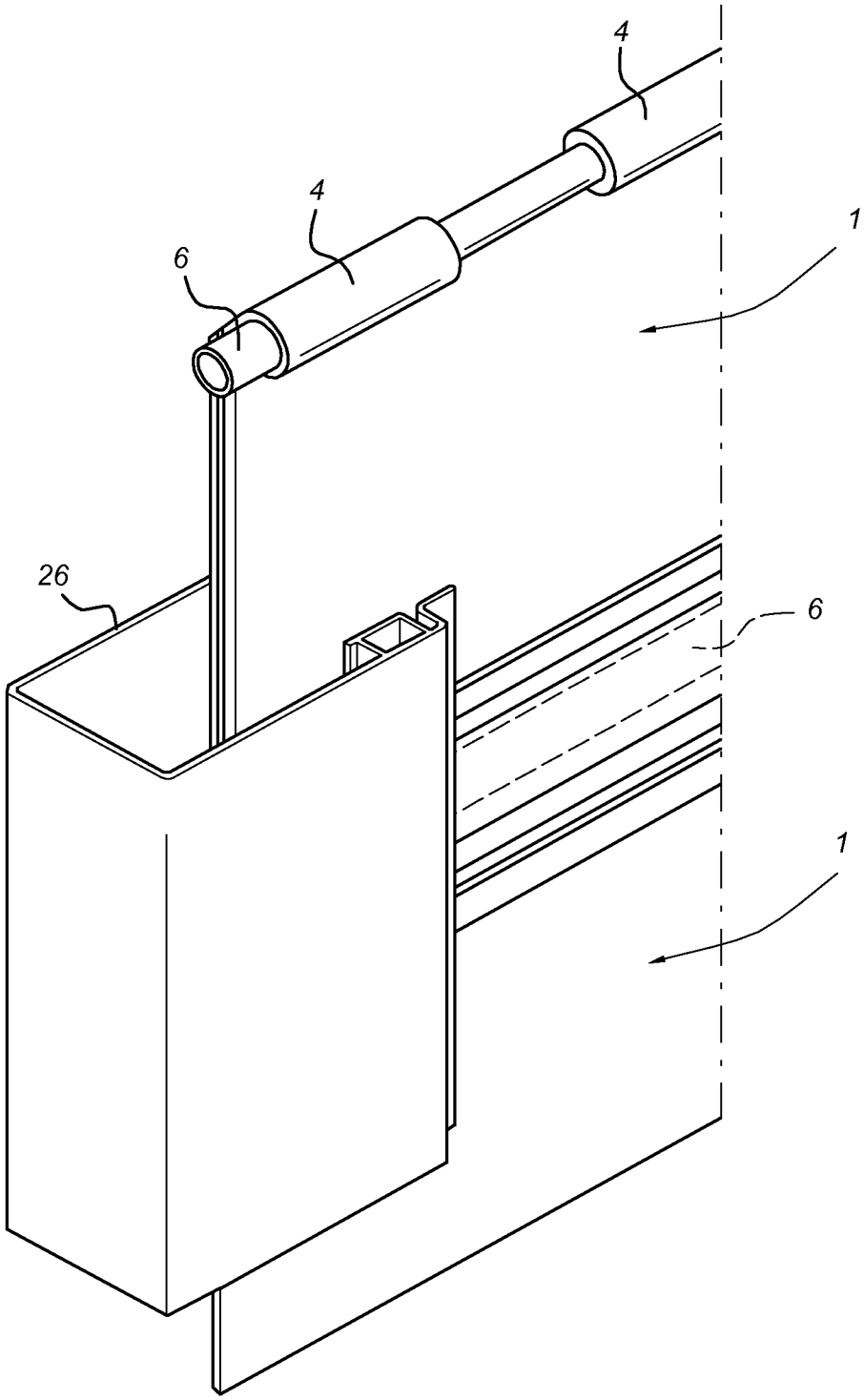
Figure 17:
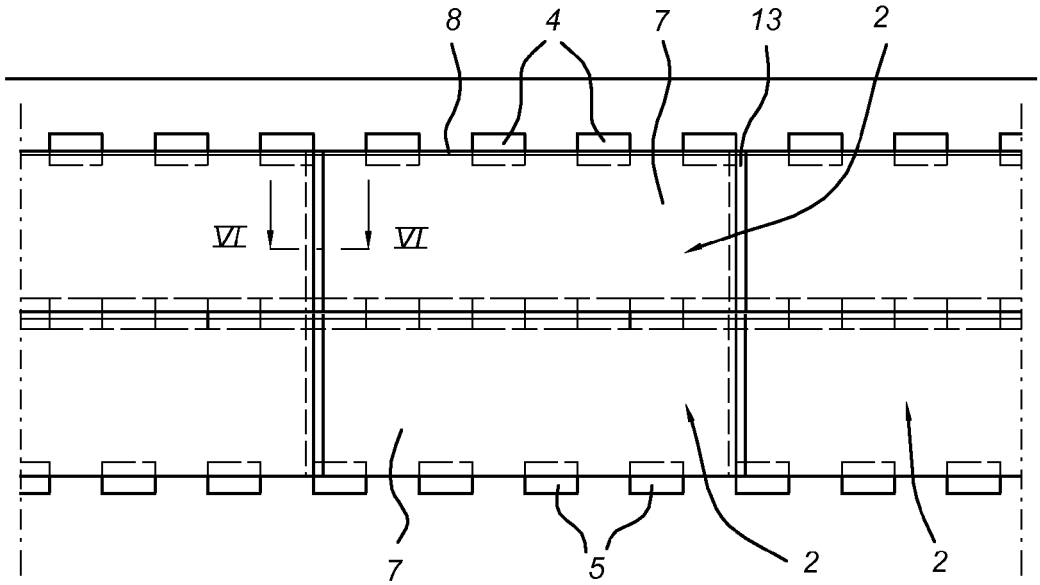
Figure 18:
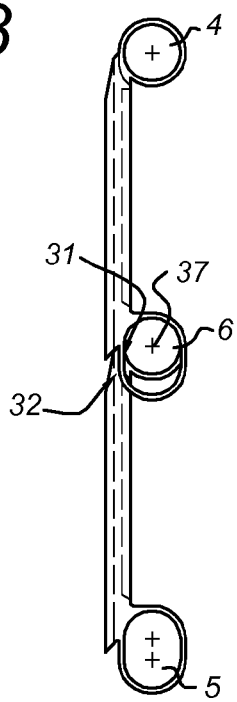
Figure 19:
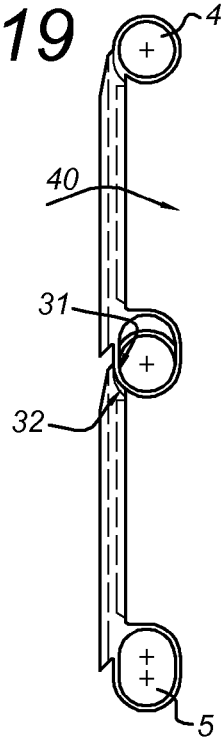
Figure 20:
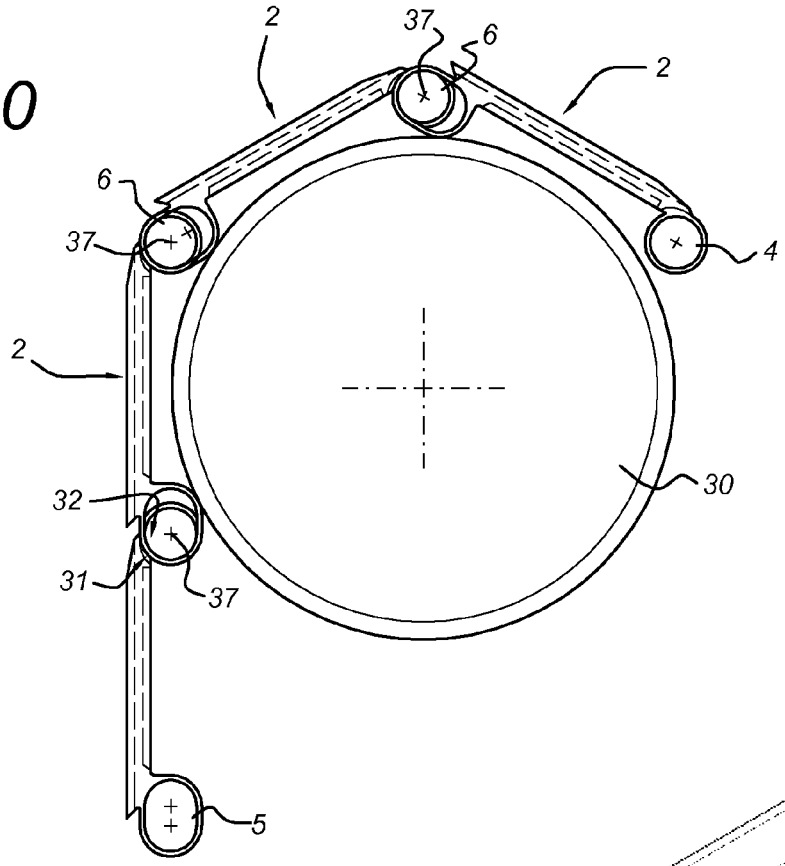
Figure 21:
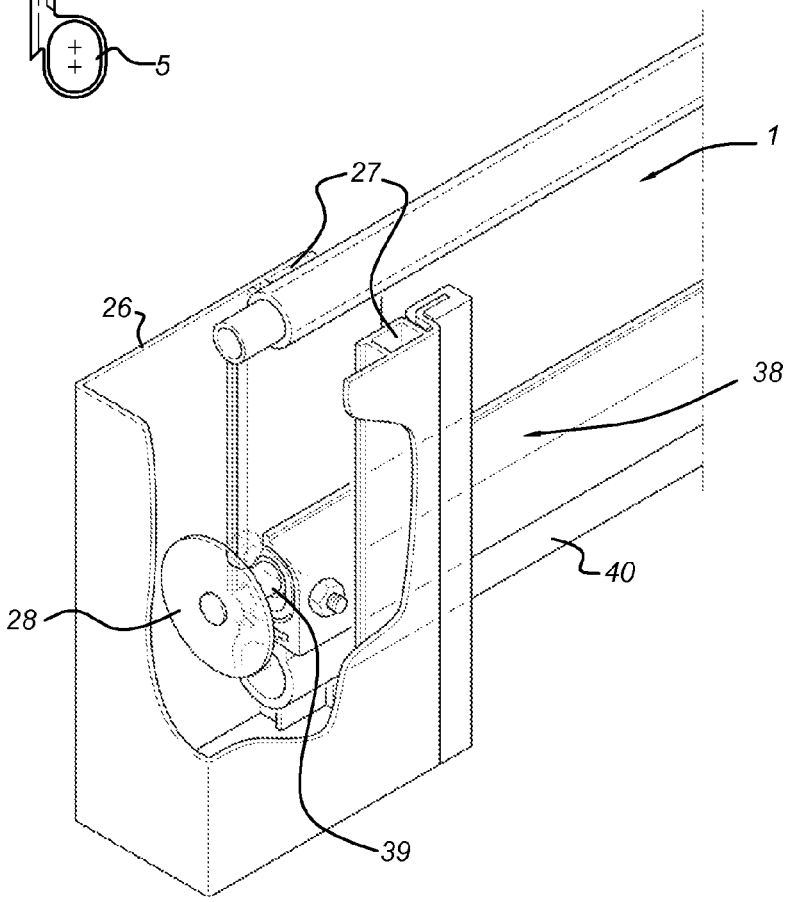

FIGS. 6*a*, 6*b*, 6*c* and 6*d* show alternatives for the connection in the cross section along VI-VI from FIG. 5;

FIG. 7 shows a second variant of the roller shutter;

FIG. 8 shows a third variant of the roller shutter;

FIG. 9 shows a fourth variant of the roller shutter;

FIGS. 10*a*, 10*b* and 10*c* show the cross sections along X-X in FIG. 9;

FIG. 11 shows a cross section through a variant of a link for a roller shutter;

FIG. 12 shows an enlarged view X11 as illustrated in FIG. 13, of an assembly comprising two links from FIG. 11, rotated in the opposite direction;

FIG. 13 shows an example of a use of the links from FIGS. 11 and 12;

FIG. 14 shows the cross section along XIV in FIG. 13;

FIGS. 15 and 16 show further embodiments in perspective;

FIG. 17 shows a fifth variant of the roller shutter;

FIG. 18 shows a cross section through the links according to FIG. 1, in closed and locked position;

FIG. 19 shows a cross section through the links according to FIG. 18, in open and free position;

FIG. 20 shows a cross section through the links according to FIG. 18, in open and free position and rotated in the rolled up or first position;

FIG. 21 shows a further embodiment.

The roller shutter illustrated in FIG. 5 comprises a series of rows, which are denoted overall by reference numeral 1, of links 2. These rows 1 are rotatably connected to one another by hinged connections 3.

Each link comprises a link plate 7 having two longitudinal edges 8, 9, two main surfaces 10, 11 (front surface 10 and rear surface 11), as well as two transverse edges 12, 13. Bushes 4 are provided near the longitudinal edges 8 which are at the top in FIG. 5, and the bushes 5 are provided near the bottom longitudinal edges 9. Furthermore, each link 2 has an auxiliary plate 16 which extends next to the main surface 11, parallel to the link plate 7. Such a double-walled design of the links 2 provides a relatively high degree of strength as well as a good insulating effect. This insulating effect is optimized if the link plate 7 and the auxiliary plate 16 are connected to one another by a partition 18 at their transverse edges 12, 13, in such a manner that a closed space is formed between the link plate 7, the auxiliary plate 16 and the two partitions 18 which are situated on the transverse edges 12, 13.

Figure 2:
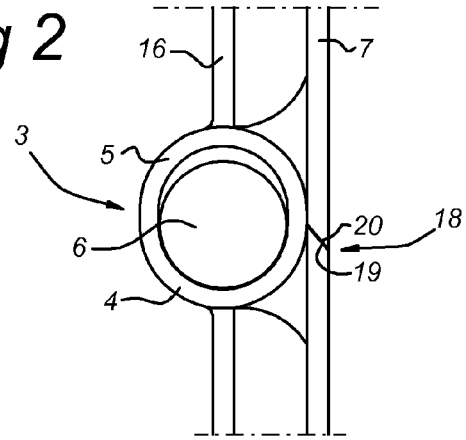
FIGS. 2, 3 and 4 show alternative details of the roller shutter.
Figure 3:
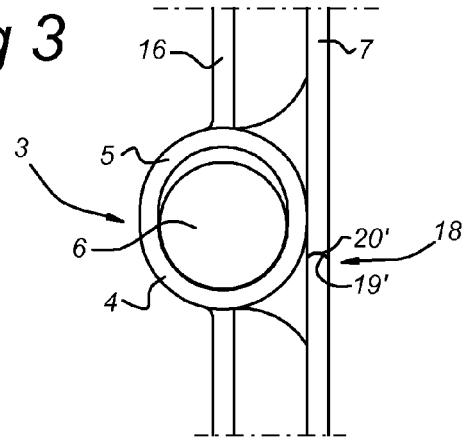
Figure 4:
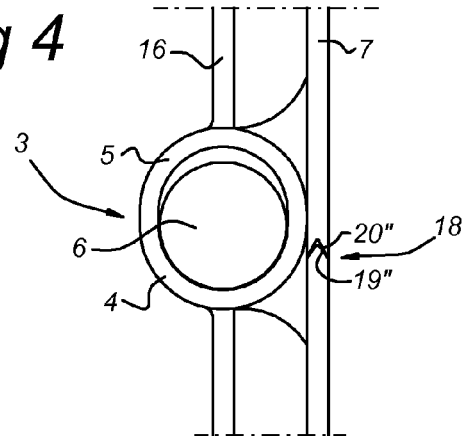

Together with the hinge pins 6, the intermating bushes 4, 5 form a hinged connection 3. As is illustrated in FIGS. 1-4, the internal dimensions of the bushes 4, 5 are slightly larger than the outer dimensions of the hinge pins 6. When the roller shutter is unrolled or rolled up in a first direction as shown in FIG. 1, this creates a slight distance between opposite end faces 19, 20 at their longitudinal edges 8, 9. However, as soon as the roller shutter is completely unrolled and the bottom row 1 rests on its stop, the pairs of end faces 19, 20 will however come to rest on one another, as is illustrated in FIG. 3. This play can be achieved by making the inside of the bushes elongate, or by giving the bushes an excess circular shape with respect to the hinge pins 6. However, it is also possible to make the inside of the bushes 4, 5 cylindrical in such a manner that the hinge pins 6 fit into the latter with little play.

As is illustrated in FIG. 1, the link plates 7 extend up to approximately halfway along the bushes 4, 5. As these bushes 4, 5 are also situated outside the link plates 7, that is to say touching the one main surface 11, the link plates 7 of neighbouring links 2 can touch one another in the unrolled state, as is illustrated in FIGS. 1, 2 and 3. The outer surface of the unrolled roller shutter is thus completely flat and reliably sealed against rain, dirt and the like.

In the variant from FIGS. 1 and 2, the end faces 19, 20 are bevelled, so that a roof tile-like cover is produced which further prevents dirt and liquids from penetrating. In the variant from FIG. 3, the end faces 19' are convex and the end faces 20' concave. This also contributes to a good sealing. In the variant from FIG. 4, the end faces 19", 20" are of bent design.

In the variants from FIGS. 6*a*, 6*b*, 6*c* and 6*d*, the seals are shown between the two links 2 of a row 1. These links 2 have closure means 14 in the form of lips 15 which overlap. According to the variants from FIGS. 6*b* and 6*d*, in each case one of the lips 15 has a thickening 17; according to the variant from FIG. 6*d*, both lips 15 of each link 2 have a thickening 17. The links 2 are supported by these thickenings 17 when they are rolled up and unrolled. The variants from FIGS. 6*a* and 6*b* furthermore have offset and overlapping transverse edges 12, 13; the variants from FIGS. 6*c* and 6*d* have straight transverse edges.

In the above description, a roller shutter is described in which the hinge pins of the hinge parts are oriented horizontally. According to the alternative embodiment from FIG. 7, these may also be oriented vertically.

In the variant from FIG. 8, a roller shutter is illustrated which has a single wall, and thus only has the link plate 7, but no auxiliary plate 16. In this variant as well, the bushes 4 are positioned eccentrically with respect to the link plate 7, in particular only on the main surface 11 thereof. In this variant, the end faces 19, 20 can come to lie sealingly against one another as well in order to provide a completely water-tight surface in the unrolled state of the roller shutter. Although FIG. 8 shows the oblique end faces 8, 9, these end faces may also have other shapes, for example the concave/convex shape illustrated in FIG. 3, the pointed shape illustrated in FIG. 4, etc.

In the embodiment illustrated in FIG. 5, the links 2 are offset with respect to one another. However, it is also possible to place the links 2 in rows one above the other. It is also possible to offset the links 2 with respect to one another in a manner other than symmetrical, as is illustrated in FIG. 5. In the non-symmetrically offset position of the links 2, the transverse edges 12, 13 are not at the centre of the links 2 in a neighbouring row 1, but offset with respect to the centre.

In the variant from FIG. 9, the links 2 do not overlap by half, but by a quarter/three-quarter. The advantage of this embodiment is that the external appearance of the roller shutter becomes simpler. The links from neighbouring rows can also be arranged one directly above the other without overlapping, as is illustrated in the variant from FIG. 17.

Figure 6A:
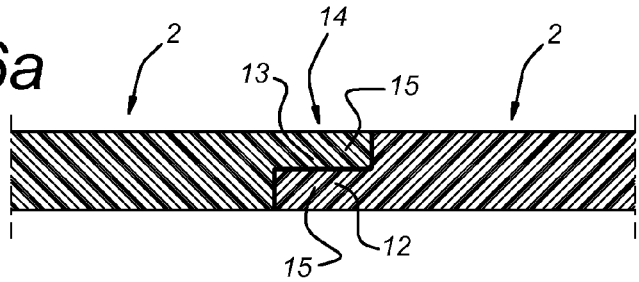
Figure 6B:
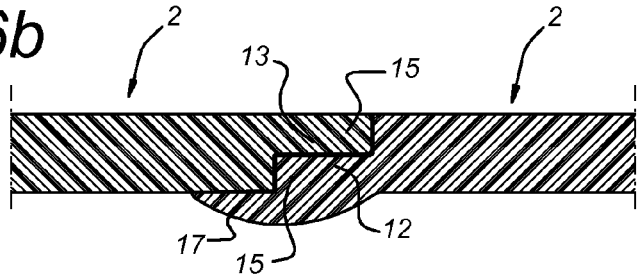
Figure 6C:
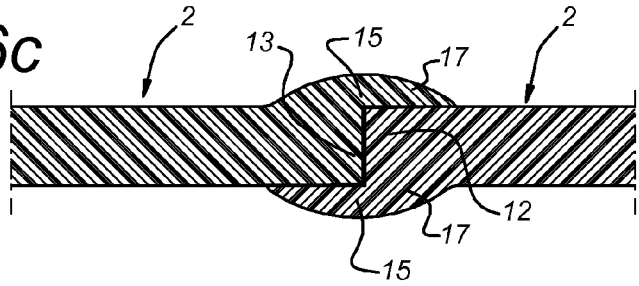
Figure 6D:
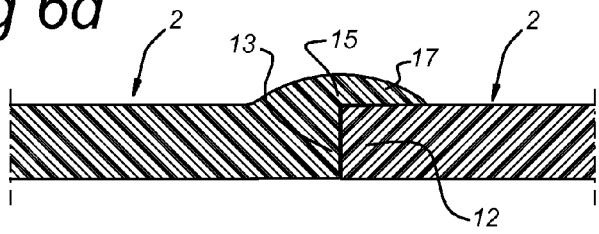

In FIGS. 10*a*, 10*b* and 10*c*, the cross sections along X-X are illustrated, in accordance with the variants from FIGS. 6*a*, 6*b* and 6*c*. The link plates 7 and the auxiliary plate 16 are connected to one another by means of the transverse edges 12, 13 in such a manner that a closed internal space is produced. Said internal space is also closed at the top side and bottom side of the links 2. The insulating effect of the links 2 designed in this way is thus increased.

FIG. 12 shows a link, the bushes 5 of which, on the bottom longitudinal edge 9, have a cavity 24 with an elongate shape, viewed in the direction from the one longitudinal edge 9 to the other longitudinal edge 8. In the illustrated exemplary embodiment, the bushes 4 on the top longitudinal edge 8 have a cylindrical cavity 25, but it is also possible for the bushes on the bottom longitudinal edge to have a cylindrical shape and the bushes on the top longitudinal edge to have an elongate shape, and/or for the bushes on both longitudinal edges to have an elongate shape.

Like the above-described links 2, the link illustrated in FIG. 11 has a top, oblique end face 19 and a bottom, correspondingly oblique end face 20. In the state in which the links 2 from FIG. 11 rest on top of one another in a flat plane, said end faces 19, 20 sealingly adjoin one another in the manner described above. In addition to these end faces 19, 20, the links comprise stop faces 22, 23 which constitute second stop means for limiting the mutual rotation of the links with respect to each other in the second direction or backwards. As is illustrated in FIG. 11, the angle with respect to the vertical of the stop face 22 is smaller than that of the stop face 23. The difference between these angles determines the pivot angle through which the links can pivot backwards with respect to one another, as is illustrated in FIG. 12. In FIG. 12, the stop face 23 of a top link bears against the stop face 22 of a bottom link.

The purpose of this embodiment is illustrated in FIGS. 13 and 14, which show the roller shutter arranged in front of an opening, such as an entrance 27 in a façade 28. The box 29 containing the connecting rod 30 for the roller shutter is arranged on the outside of the façade 29. Therefore, the links 2 have to be able to bend backwards slightly in the second direction when they approach the box 29 and the winding shaft 30, in the manner shown in FIG. 12. As soon as the links 2 then reach the winding shaft 30, they can be wound onto the winding shaft in the first direction or which is opposite to the second direction.

This movement of the links is guided by the guide rails 26 which are known per se and which are attached on either side of the roller shutter on the façade. These have a, for example, U-shaped cross section, as is illustrated in FIG. 14, through which the hinge pins 6 and the links extend and are displaceably guided. FIG. 15 shows that the guide rails 26 may have inwardly projecting flanges, behind which the widened head 28 is in each case attached at the end of the hinge pins. This embodiment provides a locking of the hinge pins with respect to the guide rails, in such a manner that the shutter remains in place even in the case of significant frontal loads ("ram raid"). The embodiment in FIG. 16 shows that the widened head can also be omitted.

The embodiment of the links according to FIGS. 11 and 12 is further highlighted in FIGS. 18 and 19. Said links comprise furthermore first stop means 31, 32 which limit the rotation of the links with respect to each other in the first direction. However, this blocking action of the stop means 31, 32 is only obtained in the closed position of the links, that is the position in which these links rest on top of each other as described before. The latter position is shown in FIG. 18. The rotational axis of the hinge pin 6 is offset with respect to stop means 32 on the outer surface of the bush 5, whereby said stop means 32 of the upper link 2 abuts the stop means 31 on the inner surface of the link plate 7 of the lower link 2 thus preventing rotation of these links with respect to each other in the first direction 40.

In the open position of FIG. 18, the stop means 32 on the outer surface of the bush 5 of the upper link 2 is lifted away from the stop means 31 on the inner surface of the link plate 7 of the lower link 2, whereby said mutual rotation of the links 2 in the first direction 40 is allowed as also shown in FIG. 20.

In the locked position or closed position of the links 7, flat outer surface part 33 of the bush 5 rests against flat inner surface part 35 of the link plate; similarly, in said locked position curved outer surface part 34 of bush 5 rests against curved inner surface part 36 of link plate 7. In the lifted position of the links, these surface parts are at a distance from each other allowing the mutual rotation of said links in the first direction.

FIG. 21 shows a further detail of a widened head 28, similar to FIG. 15, which is connected to a separate bottom profile 38 connected to the lower end link plate 1. The bottom profile has a cavity 38 within which the pin 4*o* holding the widened head 28 is clamped.

FIG. 21 also shows that the bottom profile 38 carries a sealing profile of a relatively soft material, which provides a sealing with respect to the bottom.

LIST OF REFERENCE NUMERALS

1. Row
2. Link
3. Hinged connection
4. Bush
5. Bush
6. Hinge pin
7. Link plate
8. Longitudinal edge
9. Longitudinal edge
10. Main surface
11. Main surface
12. Transverse edge
13. Transverse edge
14. Transverse edge of closure means
15. Lip
16. Auxiliary plate
17. Thickening
18. Closure means
19. End face
20. End face
21. Partition
22. Second stop means of link plate 7
23. Second stop means of link plate 7
24. Cavity
25. Cavity
26. Guide rails
27. Entrance
28. Facade
29. Box
30. Shaft
31. First stop means of bush 5
32. First stop means of link plate 7
33. Flat surface part of stop means 32
34. Curved surface part of stop means 32
35. Flat surface part of stop means 31
36. Curved surface part of stop means 31
37. Axis of hinge pin

The invention claimed is:

1. A roller shutter, comprising:

a series of links, each of which comprising:

a link plate having a front surface and a rear surface, two opposite longitudinal edges and two opposite transverse edges, and eccentric hinge parts positioned near the longitudinal edges, wherein two adjacent links are hingedly connected to one another by the hinge parts, wherein the hinge parts comprise hinge pins and bushes extending from and touching the front surface distributed at regular intervals along the longitudinal edges, and the bushes on one of the end faces are offset with respect to the bushes on another end face of a link so that the bushes of two adjacent links engage with one another, the hinge pins being loosely accommodated in the bushes, wherein said series of links are configured to be moved between a rolled up stated and an unrolled state by being moved along at least one guide rail and then rotated in a first direction with respect to one another and wherein the links are configured such that in the unrolled state, adjacent links touch each other to define a substantially flat plane, wherein the bushes, on at least one of the longitudinal edges, each define a cavity having an elongated, oval shape, viewed in a direction from one of the longitudinal edges to the other longitudinal edge, into which the hinge pins fit such that the links are moved between an open position in which the longitudinal edges of adjacent link plates are at a distance from each other and allow rotation of said links in said first direction, and a closed position in which the series of links are in an unrolled, flat state, and the links are in sealing engagement with each other, and wherein each of the links comprises first stop surfaces that prevent rotation of the links with respect to one another in said first direction when in the closed position.

2. The roller shutter according to claim 1, wherein the first stop surfaces for each link plate comprise an outer surface of the bushes and an opposite inner surface of another link plate coupled to said each link plate, wherein the links are configured such that:

in the closed position of said links, said outer surface and said opposite inner surface are opposite and abutting each other when said links define said flat plane such that rotation in the first direction is prevented, and in the open position of said links, said outer surface and said opposite inner surface are shifted sideways with respect to each other, allowing rotation of said links in the first direction.

3. The roller shutter according to claim 2, wherein said outer surface and said opposite inner surface are at least partly flat.

4. The roller shutter according to claim 3, wherein said outer surface and said opposite inner surface are at least partly curved.

5. The roller shutter according to claim 1, wherein the links are configured to be rotatable with respect to one another from the flat plane in a second direction which is opposite to the first direction.

6. The roller shutter according to claim 5, further comprising second stop surfaces that prevent rotation of the links with respect to one another in the second direction beyond a maximum angular rotation.

7. The roller shutter according to claim 6, wherein said second stop surfaces comprise a stop face on both longitudinal edges of each of the links, said stop faces facing obliquely at two different angles with respect to a cross section of the links, wherein a difference between the two different angles is equal to a maximum angle through which the links can be rotated with respect to one another in the second direction from the flat plane.

8. The roller shutter according to claim 7, wherein one of the stop faces is situated near to an end face.

9. The roller shutter according to claim 1, wherein the hinge parts are formed completely on the rear surface of the link plate and are face away from the front surface.

10. The roller shutter according to claim 1, further comprising rows of links, wherein transverse edges of the links abut one another.

11. The roller shutter according to claim 10, wherein the transverse edges of the links comprise a closure means.

12. The roller shutter according to claim 11, wherein the closure means comprise end faces which are disposed on the longitudinal edges of the link plates.

13. The roller shutter according to claim 12, wherein the end faces face obliquely, with respect to a cross section which is at right angles to a pivot axes of the hinge parts.

14. The roller shutter according to claim 13, in which one of the end faces of the link plates faces away from the hinge parts and another one of the end fac38-es is directed towards the hinge parts.

15. The roller shutter according to claim 12, in which the end faces have a bent cross-sectional shape.

16. The roller shutter according to claim 12, in which one of the end faces of the link plate is convex in cross section and another of the end faces is concave.

17. The roller shutter according to claim 12, wherein a distance between both end faces of each link is substantially equal to a distance between a center axis of the hinge parts thereof.

18. The roller shutter according to claim 17, in which, in the unrolled state, the lower end face is concave, which lower concave end face covers the adjacent end face of the lower link.

19. The roller shutter according to claim 12, wherein a thickness of each end face is constant in a direction of a pivot axis of the hinge parts.

20. The roller shutter according to claim 11, wherein the closure means comprises a flexible element which extends along the longitudinal edges.

21. The roller shutter according to claim 11, wherein a pivot axes of the hinge parts are horizontal.

22. The roller shutter according to claim 21, wherein the closure means comprise end faces which are disposed on the longitudinal edges of the link plates, the end faces having a bent cross-sectional shape, and wherein in the unrolled state of the series of links, a lower oblique end face of a link is directed towards a main surface which faces towards the hinge parts, and the lower oblique end face covers a higher end face of the lower link.

23. The roller shutter according to claim 10, further comprising a lip is situated on one of the transverse edges of each link, said lip extending over a transverse edge of a neighboring link.

24. The roller shutter according to claim 10, wherein at least one of the transverse edges of the links comprises a thickening.

25. The roller shutter according to claim 1, wherein each of the links comprises an auxiliary plate extending adjacent to a main surface of the link plate on which the hinge parts are disposed.

26. The roller shutter according to claim 25, wherein the link plate and the auxiliary plate of each link are connected to one another at transverse edges of the link plate and auxiliary plate by partition on each side, such that a space between the link plate, the auxiliary plate and the two partitions is closed.

27. The roller shutter according to claim 25, wherein the link plate, the auxiliary plate and the transverse edges of each link define a closed internal space.

28. The roller shutter according to claim 1, wherein the links are made of transparent plastic material.

29. The roller shutter according to claim 1, in which the hinge parts have vertically oriented pivot axes.

30. The roller shutter according to claim 1, further comprising closure means disposed on the longitudinal edges of the link plates, wherein the closure means of the link plates in the closed position are engaged with respect to one another in the unrolled, flat state of the series of link.

* * * * *